US006827299B2

(12) United States Patent
Scotchmur et al.

(10) Patent No.: US 6,827,299 B2
(45) Date of Patent: Dec. 7, 2004

(54) GANG MOUNTABLE SPRAY GUN

(75) Inventors: Ronald R. Scotchmur, Schiller Park, IL (US); Gerald P. Ferrazza, Schaumburg, IL (US)

(73) Assignee: Spraying Systems Co., Wheaton, IL (US)

( * ) Notice: Subject to any disclaimer, the term of this patent is extended or adjusted under 35 U.S.C. 154(b) by 182 days.

(21) Appl. No.: 10/350,813

(22) Filed: Jan. 24, 2003

(65) Prior Publication Data

US 2004/0144872 A1 Jul. 29, 2004

(51) Int. Cl.[7] ..... B05B 1/30

(52) U.S. Cl. ..... 239/583; 239/290; 239/296; 239/407; 239/411; 239/423; 239/424; 239/433; 239/551; 239/600

(58) Field of Search ..... 239/290, 296, 239/407, 408, 410, 411, 418, 423, 424, 433, 550, 551, 583, 584, 600

(56) References Cited

U.S. PATENT DOCUMENTS 3,066,874 A 12/1962 Becker
3,348,520 A * 10/1967 Lockwoon ..... 239/551
3,396,911 A 8/1968 Norris
3,490,701 A 1/1970 Malec
4,738,400 A * 4/1988 Irwin ..... 239/583
5,707,010 A 1/1998 Manfre et al.
5,899,387 A 5/1999 Haruch
6,036,107 A 3/2000 Aspen et al.
6,170,760 B1 1/2001 Bievenue et al.
6,276,492 B1 * 8/2001 Carroll ..... 239/423
6,619,566 B2 * 9/2003 Gressett et al. ..... 239/296

* cited by examiner

*Primary Examiner*—Steven J. Ganey
(74) *Attorney, Agent, or Firm*—Leydig, Voit & Mayer, Ltd.

(57) ABSTRACT

A liquid spray module which can be individually used, or which can be easily mounted in ganged side-by-side relation with a plurality of such modules. Each module includes a spray gun cartridge having liquid passages through the liquid to be sprayed, is directed and one or more air passages through which pressurized air may be directed for assisting in atomization of the liquid and controlling operating movement of a valve needle. Each spray gun cartridge further includes a manifold body having a central bore into which the spray gun cartridge is removably mounted and liquid and air inlet and outlet passages which communicate with the liquid and air spray gun cartridge passages. The spray gun cartridge is removable from the manifold body without disconnection of fluid supply lines to the manifold body and without removal of the manifold body from a ganged mounted array of such spray modules.

33 Claims, 5 Drawing Sheets

GANG MOUNTABLE SPRAY GUN

FIELD OF THE INVENTION

The present invention relates generally to spray gun-type liquid spray devices, and more particularly, to a spray gun module adaptable for coupling in ganged or manifold arrays.

BACKGROUND OF THE INVENTION

Liquid spray guns are known, such as shown in U.S. Pat. Nos. 5,707,010 and 5,899,387, which use pressurized air to both assist in atomization of the liquid to be sprayed and to actuate a reciprocatable liquid control valve needle. Because of the multiplicity of fluid supply lines that must be connected to the spray gun, it sometimes can be difficult and cumbersome to mount and connect such spray gun to the respective supply piping, particularly if a plurality of spray guns are to be coupled to common fluid supply sources. Moreover, while for particular spray applications, it often is desirable to mount a plurality of such spray guns in a side-by-side array, not only can such mounting become complicated, but it can be difficult to remove an individual spray gun for repair and replacement without disassembly of the entire array. Furthermore, when mounted in such an array, it can be difficult to adjust the liquid discharge from individual spray guns and to ensure proper aligned direction of the discharging spray.

OBJECTS AND SUMMARY OF THE INVENTION

It is an object of the present invention to provide a liquid spray gun module which lends itself to easy mounting, when used individually or in conjunction with a plurality of spray gun modules.

Another object is to provide a spray gun module as characterized above which can easily be mounted in a side-by-side ganged or manifold arrangement with the spray gun modules of the array being supplied with pressurized air and liquid from common fluid supplies.

A further object is to provide a ganged may of spray gun modules of the foregoing type which permits easy removal and replacement of the individual spray guns.

Still another object is to provide a ganged array of spray gun modules of the above kind in which the discharging liquid flow rate and spray characteristics of the spray gun modules may be individually controlled and adjusted.

Yet a further object is to provide a spray gun module of the above type which is relatively simple and economical in construction, and which lends itself to reliable operation and use.

Other objects and advantages of the invention will become apparent upon reading the following detailed description and upon reference to the drawings, in which:

Figure 1:
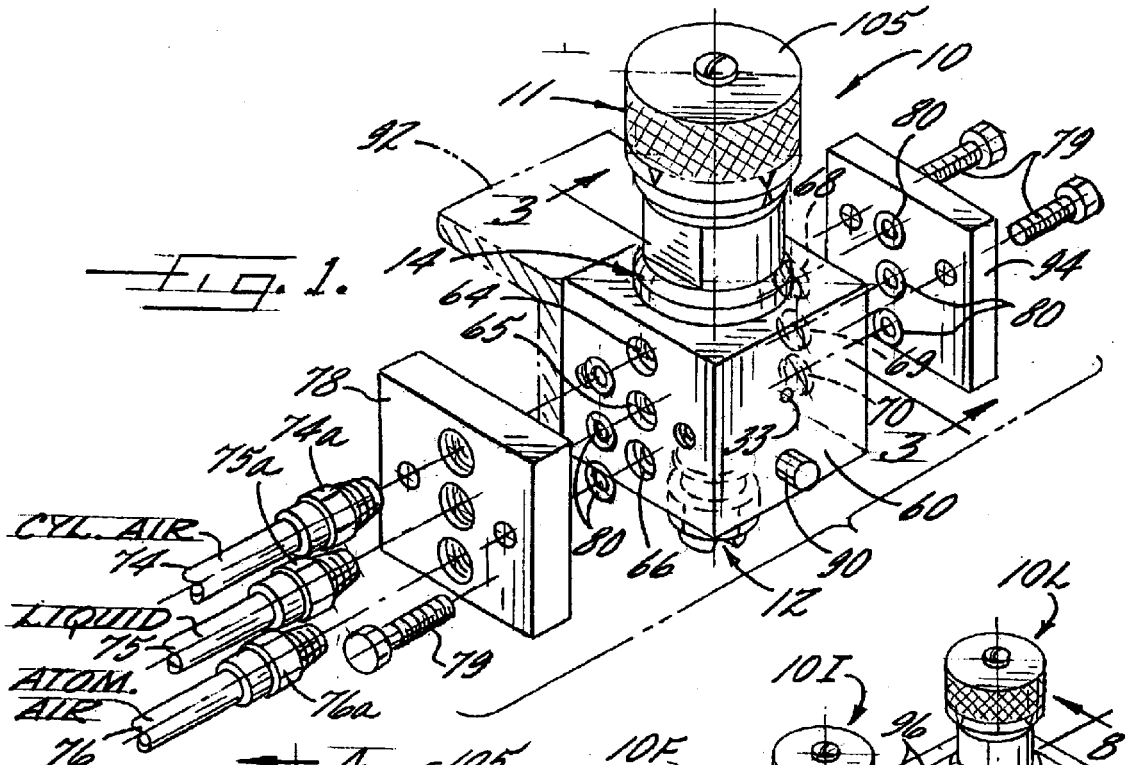
FIG. 1 is an exploded perspective of an illustrated spray gun module in accordance with the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to the drawings, there is shown an illustrative spray gun module 10 in accordance with the invention. The module 10 includes a spray gun cartridge 11 which in this case is vertically oriented for discharging a downwardly directed liquid spray. The illustrated spray gun cartridge 11 comprises a cartridge body 14 having a spray nozzle assembly 12 at a discharge end and a reciprocatable valve needle 15 for controlling the discharging liquid spray.

Figure 3:
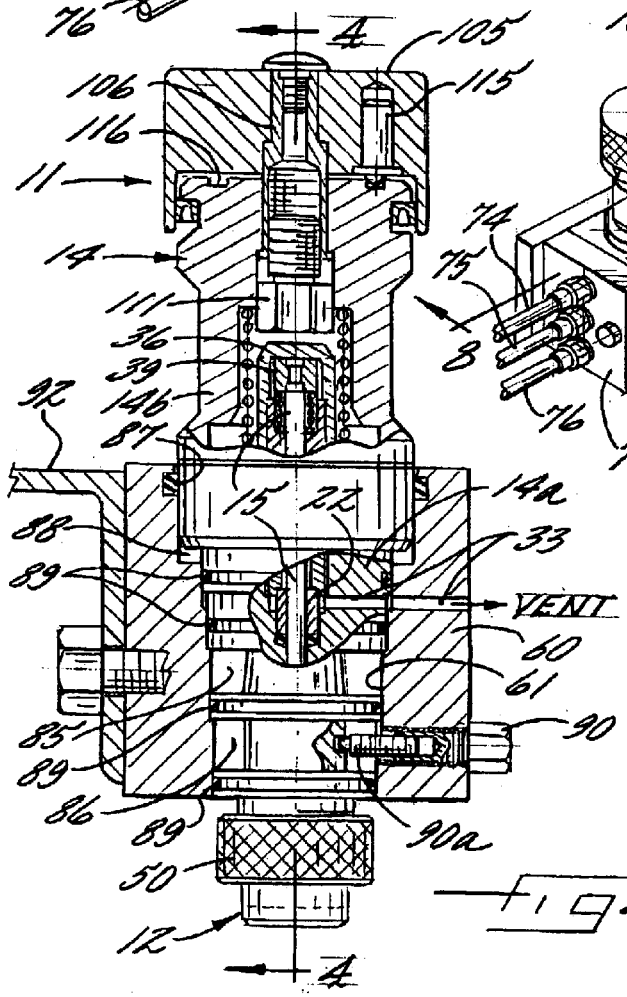
FIG. 3 is an enlarged vertical section of the spray gun module shown in FIG. 1, taken in the plane of line 3—3.
Figure 4:
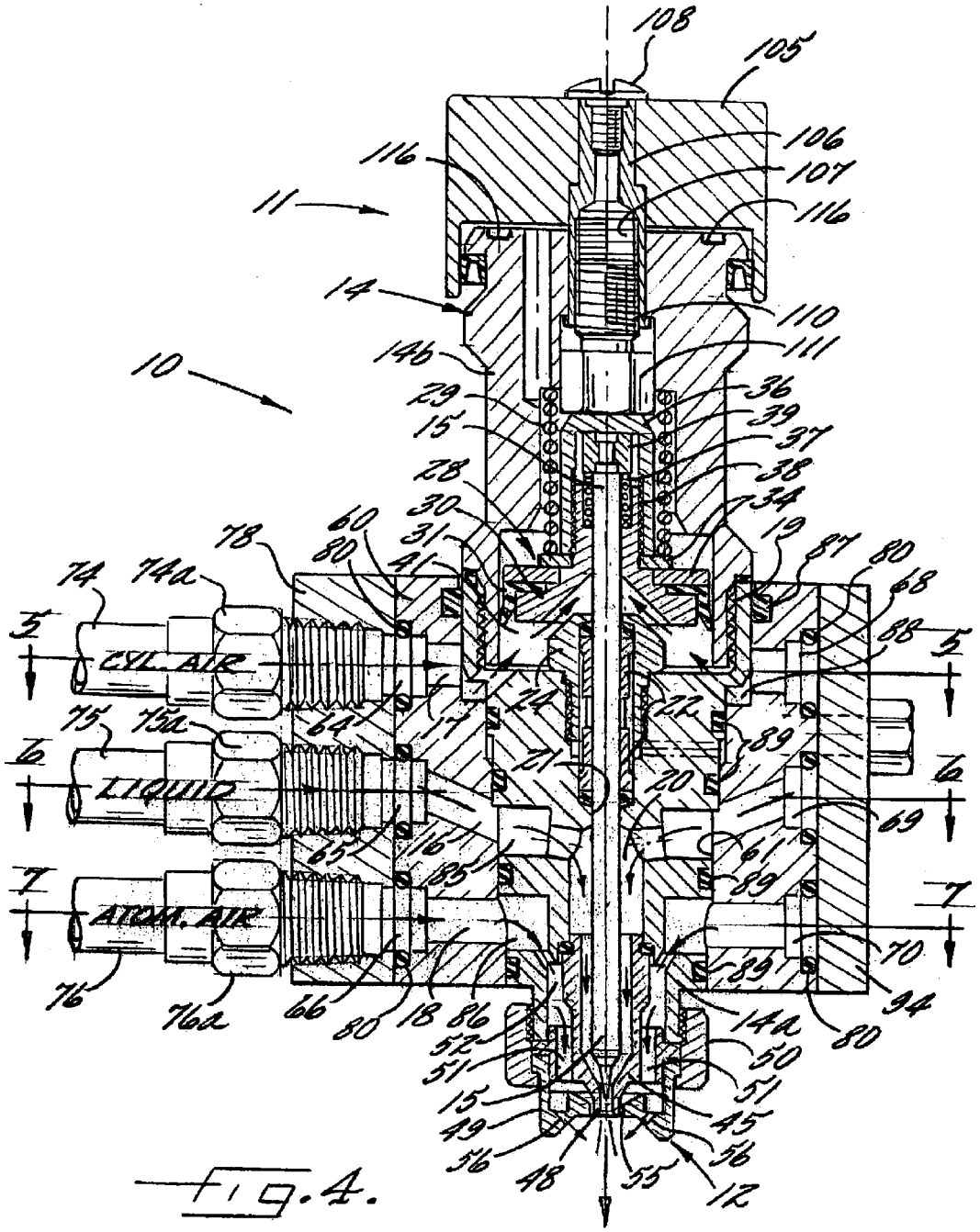
FIG. 4 is an enlarged vertical section of the illustrated spray gun module, taken in the plane of line 44 in FIG. 3.
Figure 5:
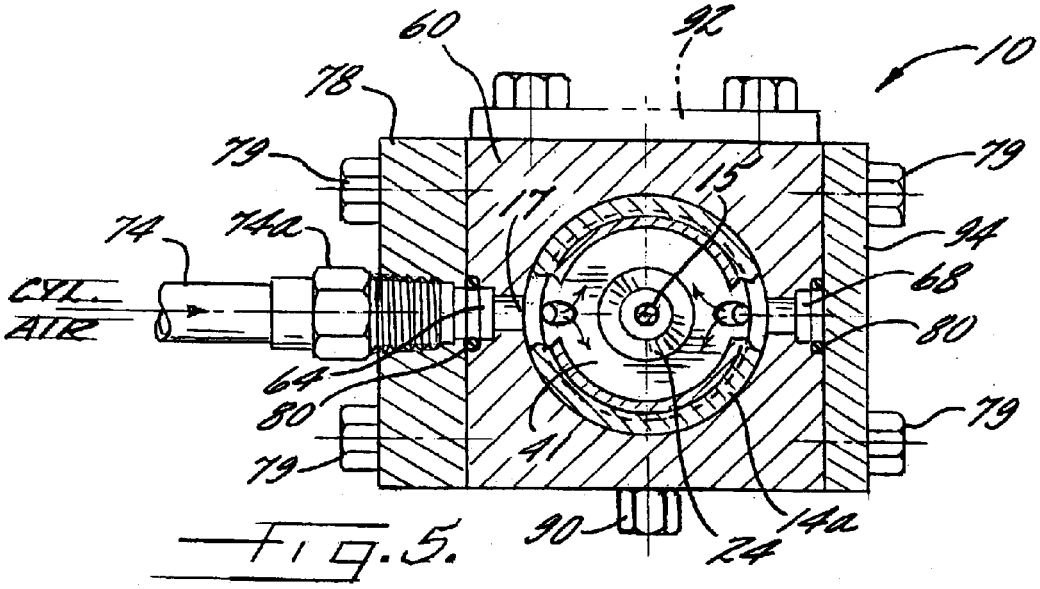
FIGS. 5, 6 and 7 are horizontal sections of the illustrated spray gun module, taken in the planes of lines 5—5, 6—6, and 7—7 of FIG. 4, respectively.
Figure 6:
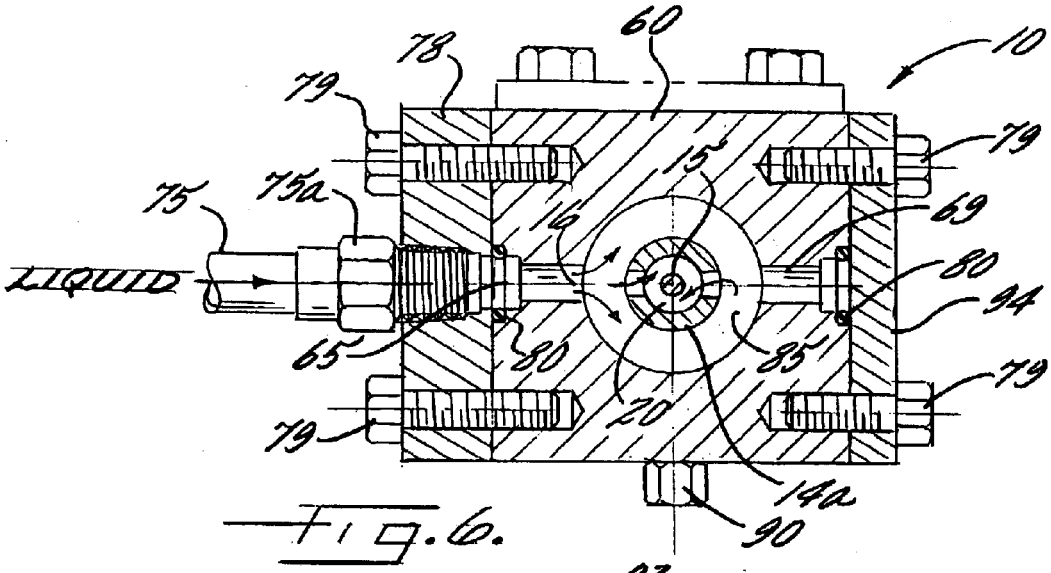
Figure 7:
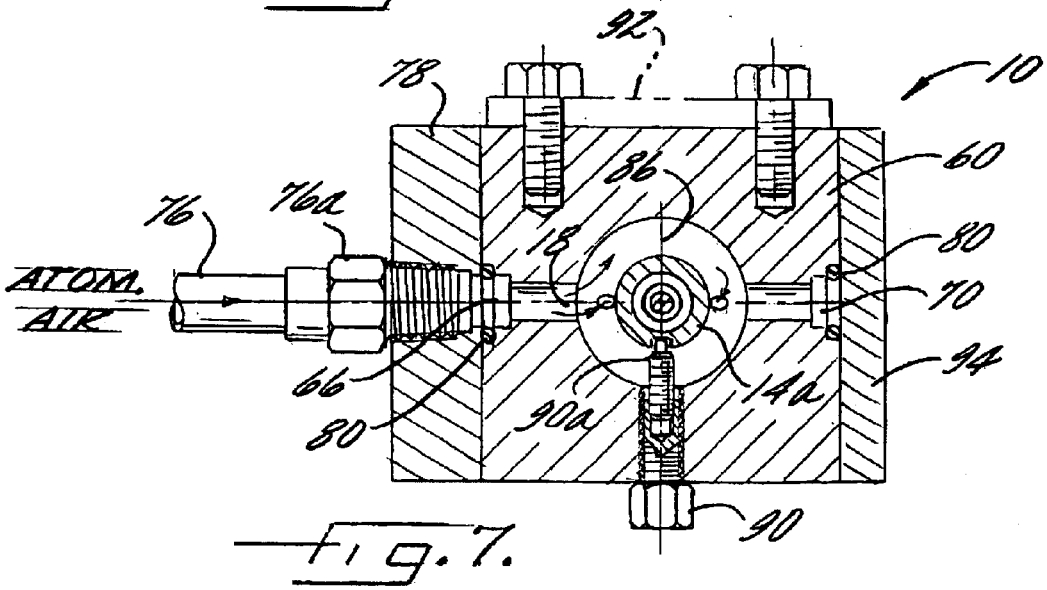

The cartridge body 14, as best shown in FIGS. 3–4, has an elongated two-part construction, comprising generally cylindrical forward and rearward body sections 14*a*, 14*b* which are joined to one another by a threaded inner connection 19. The cartridge body 14 has a liquid, cylinder air, and atomizing air inlets 16, 17, 18, respectively, with the liquid inlet 16 communicating with a central liquid passageway 20 in surrounding relation to the valve needle 15. The valve needle 15 is a long cylindrical element which extends coaxially through the body 14 and into the nozzle assembly 12. The valve needle 15 extends through an opening 21 in the forward body section 14*a* and is supported for reciprocating movement by an annular sleeve 22, which in turn is supported at one end within the body section 14*a* and at another end by a packing nut 24 threadably mounted in the rearward end of the body section 14*a*. Annular seals are provided at opposite ends of the support sleeve 22.

For operating the valve needle 15, the rear body section 14*b* carries a drive piston assembly 28 and a compression spring 29 which is confined between an outer side of the piston assembly 28 and an internal end wall or shoulder of the body section 14*b*. The piston assembly 28 includes a piston 30 and a resilient annular cup-shaped sealing ring 31 which has sliding sealing engagement with the inner surface of a cylindrical bore formed coaxially in the body section 14*b*. The sealing ring 31 is held in position on the piston assembly by a pair of clamping rings or washers 34 that are secured by a retainer cap 36 threaded onto a rear stem portion 38 of the piston 30. An enlarged end portion 39 of the valve needle 15 is connected to the piston 30 by being captured between an end wall of the retainer cap 36 and the outer end of the piston stem portion 38 with an annular spring 37 interposed therebetween for limited play. Accordingly, the valve needle 15 is movable axially in the body 14 in accordance with selective axial movement of the piston assembly 28.

The compression spring 29 biases the piston assembly 28, and hence the valve needle 15, downwardly to a fully seated, i.e. valve "closed" position. The valve needle 15 is moved axially in the opposite direction against the force of spring 29 by supplying pressurized air or other fluid supplied (referred to herein as cylinder air) to the inlet port 17 and into a cylinder chamber 41 adjacent a forward side of the moveable piston assembly 28. As will be understood, the supply of cylinder air, may be controlled externally, such as by solenoid actuated valves, for controlled opening of the valve needle 15 to allow liquid to be discharged through the spray nozzle assembly 15. The valve needle 15 thereby may be selectively operated between on and off positions, including operation in a high-speed cyclic on-off mode, e.g. as rapid as 180 on-off cycles per minute. A downstream vent passage 33 (FIG. 3) is provided in a known manner.

The spray nozzle assembly 12, which may be of a known type, comprises a generally cylindrical nozzle body 45, fixed within a downstream end of the cartridge body 14*a*, having a forwardly extending nose portion which defines a liquid discharge orifice 48 and an air cap 49 mounted in surrounding relation to the discharge orifice 48. The air cap 49 is retained by a nut 50 threaded over the downstream end of the cartridge body 14.

The nozzle body 45 defines a valve seat upstream of the discharge orifice 48 that is engageable by the valve needle 15 for controlling the liquid discharge. To facilitate atomization and formation of the liquid discharge into the desired spray pattern, the nozzle body 45 has a plurality of passageways 51 for communicating pressurized air from an annular chamber 52 which in turn communicates with the atomizing air inlet 18. The nozzle body air passageways 51 in turn communicate with an annular air discharge orifice 55, defined between the forwardly extending nozzle body nose portion and a central opening in the air cap 49, and a plurality of opposed or surrounding air cap discharge orifices 56 disposed in outwardly spaced relation to the annular orifice 55.

In accordance with the invention, the spray gun cartridge is removably mountable in a manifold body that facilitates the supply of pressurized fluids to the spray gun cartridge and which permits easy mounting of a ganged or manifold array of such modules. More particularly, the manifold body supports the spray gun cartridge, and together they define a fluid passage system that permits interconnection of a plurality of the spray modules. In the illustrated embodiment, a manifold body 60 is provided which has a generally rectangular block shape with a central generally circular bore 61 extending therethrough within which the spray gun cartridge 11 is removably mountable. The spray gun cartridge 11 preferably extends completely through the manifold body 60, with a lower downstream end exposed below the manifold body 60 to permit removal and replacement of the spray nozzle air cap 49 and with an upper end of the cartridge 11 extending above the manifold body 60 for easy access.

For permitting the supply of pressurized liquid and air to and from the manifold body 60, the manifold body 60 is formed with respective cylinder air, liquid, and atomizing air inlet passages 64, 65, 66 on one side communicating with the central bore 61 and cylinder air, liquid, and atomizing air outlet passages 68, 69, 70, respectively in another side. The inlet passages 64, 65, 66 in this case are vertically aligned, communicating through the manifold body 60 radially of the central bore 61, and the outlet passages 68, 69, 70 are formed in the opposite side of the manifold body 60 in diametrically opposed relation to the inlet passages. With the spray gun cartridge 11 positioned within the manifold body bore 61, the cylinder air, liquid, and atomizing air inlet passages 64, 65, 66 communicate with the spray gun cartridge cylinder air, liquid, and atomizing air inlets 17, 16, 18, respectively.

For facilitating connection of cylinder air, liquid, and cartridge air supply lines 74, 75, 76 to the module 10, an adaptor plate 78 in this case is fixed, such as by bolts 79, to the inlet side of the manifold body 60 and is formed with respective threaded ports coaxial with the inlet passages 64, 65, 66 for receiving respective supply line fittings 74*a*, 75*a*, 76*a* O-ring seals 80 are provided in the manifold body 60 in outwardly opening counterbores about the inlet passages 64, 65, 66 at the interface with the adaptor plate 78. It will be understood that while the illustrated manifold body 60 and adaptor plate 78 have separate cylinder air and atomizing air passages, alter vely, a single pressurized air passage could be provided for supplying pressurized air to the inlet or inlets of interconnected cylinder air and atomizing air passages within the cartridge body 14.

In carrying out the invention, the spray gun cartridge 11 and manifold body 60 define passageways communicating between the manifold block fluid inlet passages 64, 65, 66 and outlet passages 68, 69, 70. In the illustrated embodiment, the cartridge body section 14*a* is formed with a pair of circumferential grooves 85, 86 which completely encircle the cartridge body and define generally circular fluid passageways communicating between respective inlet and outlet passages 65, 66 and 69, 70, respectively. A third annular passage 88 is formed between the spray gun cartridge body 14 and the manifold block 60, which together with the piston chamber 41 permits communication of pressurize air circumferentially about the cartridge 11 between the cylinder air inlet and outlet passages 64, 68. For sealing the atomizing air, cylinder air, and liquid passages from each other, a plurality of O-ring seals 89 are interposed between the outer perimeter of the cartridge body 14 and the inner wall of the manifold bore 61, in this case each being partially received and retained within respective outer annular grooves in the cartridge body 14. An uppermost seal 87 is contained within the manifold body bore 61.

To facilitate insertion and removal of the spray gun cartridge into and out of the manifold body 60, the cartridge body 14 and manifold bore 61 are inwardly tiered in a downstream direction (as best seen in FIG. 3), defined by a plurality of generally cylindrical sidewall sections or tiers of progressively smaller diameter. It will be appreciated that such tiered design enables the spray gun cartridge 11 to be positioned substantially into the manifold body bore 61 before engagement of the sealing O-rings 89 with the sidewalls of the manifold bore 61. This minimizes the distance the cartridge 11 must be inserted against the resistance of the multiplicity of O-rings 89 and reduces wear and the risk of potential damage to the O-rings. For locating the retaining the spray gun cartridge 11 in proper orientation in the manifold body 61, a bolt 90 threaded through an aperture in the manifold body 60 has a spring biased detent 90*a* for engaging an aperture in the cartridge body 14*a* (FIG. 3). To facilitate removal of the cartridge, the lock bolt 90 may be rotated in a loosening direction.

In keeping with the invention, the spray gun module 10 may be used individually, or may be mounted in a ganged array. When used individually, the manifold block 60 may be bolted onto a support flange or plate 92, as depicted in FIG.

1, and the adaptor plate 78 bolted to the inlet side of the manifold body 60 to facilitate connection of the fluid supply lines 74–76. When used individually, an adaptor plate 94 without passages, or with plugged passages, may be fixed by bolts to the outlet side of the manifold block 60 to close off the manifold block outlet passages 68–70. When the spray module 10 is mounted in such fashion, it can be seen that the module 10 may be easily connected to the liquid, atomizing air, and cylinder air supply lines 74–76 for directing the desired liquid spray discharge.

Figure 2:
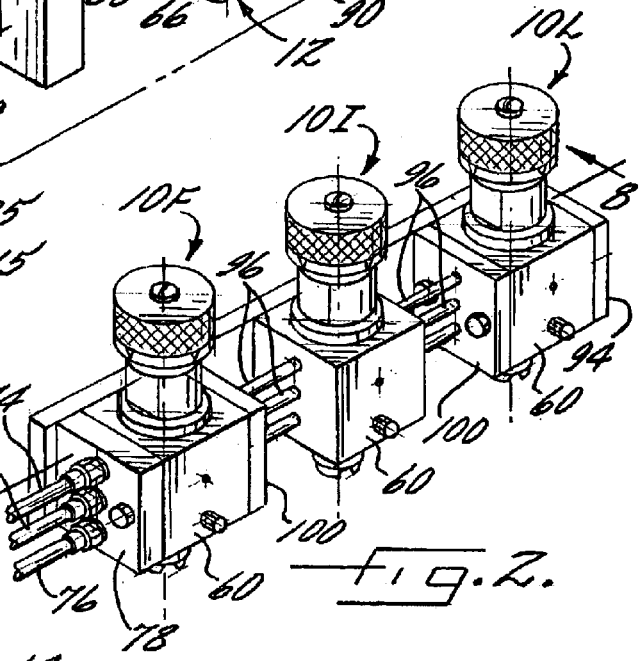
FIG. 2 is a perspective of a plurality of spray gun modules in accordance with the invention mounted in ganged or manifold side-by-side relation.
Figures 8, 9, 10:
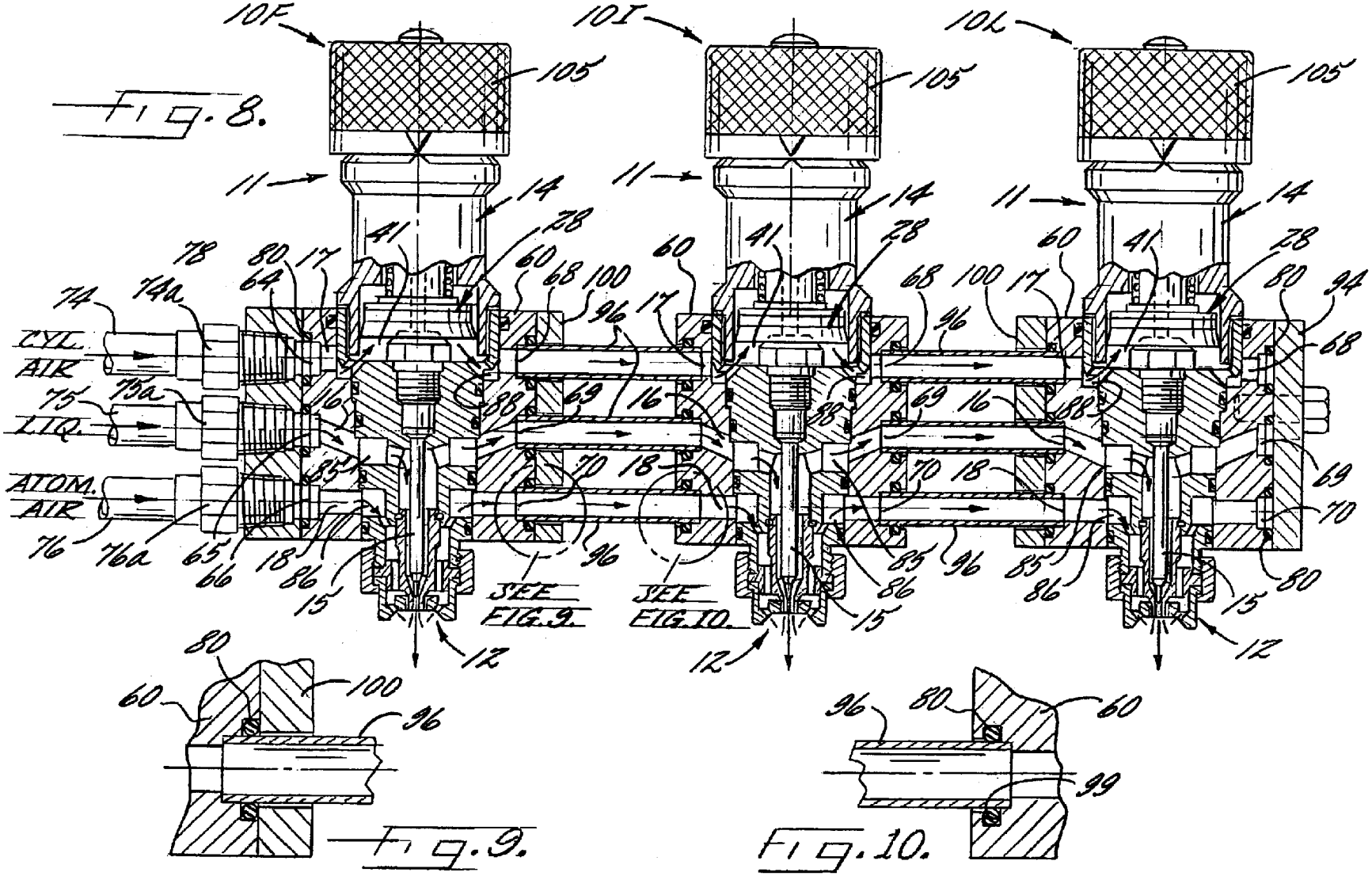
FIG. 8 is an enlarged vertical section of the ganged array of spray gun modules, taken in the plane of line 8—8 in FIG. 2.
FIGS. 9 and 10 are enlarged fragmentary sections of the respective encircled areas in FIG. 8.

In further keeping with the invention, the spray module 10 is adapted for easy mounting in side-by-side ganged or manifold arrays with a plurality of such modules, as depicted in FIGS. 2 and 8, with the individual spray modules 10 being interconnected by fluid supply pipes 96 which can be force fit into sealed mounting engagement with the modules without special tools or fasteners. In the illustrated embodiment, the manifold body 60 of each module 10 is bolted or otherwise mounted onto a common elongated support plate 98 in longitudinally spaced relation to each other. The first module in the array from the fluid supply side, designated 10F in FIG. 8, is connected to the cylinder air, liquid, and atomizing air supply lines 74–76 by an adaptor plate 78, as described above. Intermediate spray modules 10 downstream thereof, (only one of which is shown in FIG. 8, designated 101) are connected in spaced apart relation by respective fluid supply pipes 96 which can be press fit in sealing relation between the outlet passages 68–70 of one module and the inlet passages 64-66 of the adjacent module. In the illustrated embodiment, manifold bodies of the intermediate modules 101 have O-rings 80 about the inlet and outlet passages which are captively retained in grooves 99 recessed inwardly from the side face of the manifold body 10, as depicted in FIG. 10. The first spray module 10F in this case has an adaptor plate 100 fixed to the inlet side of the manifold block 96 which retains the O-rings 80 on that side in sealed engagement with the fluid supply pipes 96, as depicted in FIG. 9. The last module in the array, designated 10L, has a similar O-ring retaining adaptor plate 100 on the inlet side of the manifold body 60 and a blank or plugged adaptor plate 94 on the outlet side which closes off the outlet passages 68–70. It will be appreciated by one skilled in the art that any number of intermediate modules 101 may be provided in the array, with each intermediate module being quickly connectable between adjacent modules by insertion of the fluid supply pipes 96 between inlet and outlet sides of the module.

Figure 11:
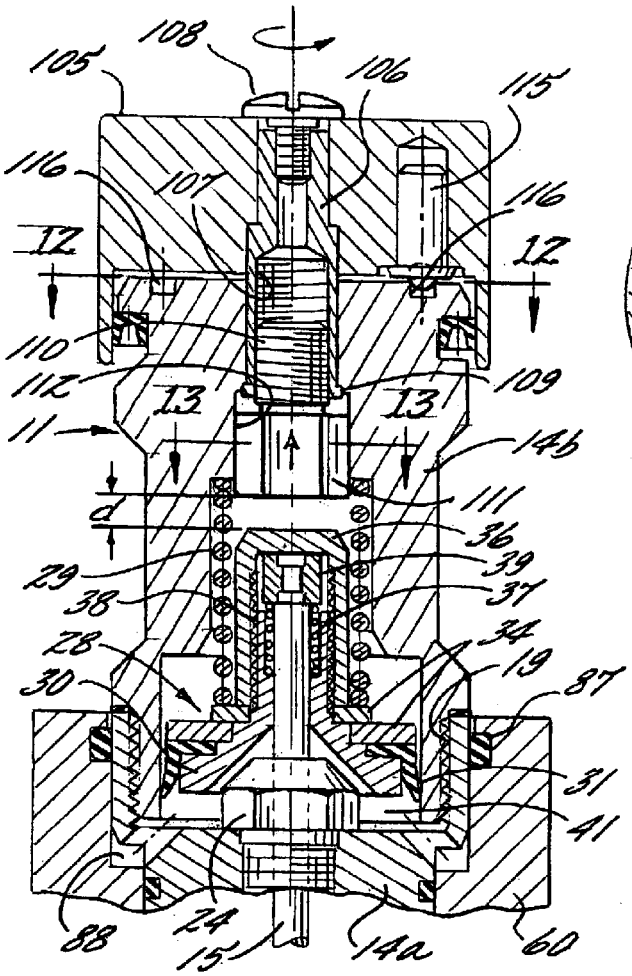
FIG. 11 is an enlarged vertical fragmentary section of the illustrated spray gun module, illustrating the valve control mechanism.
Figure 12:
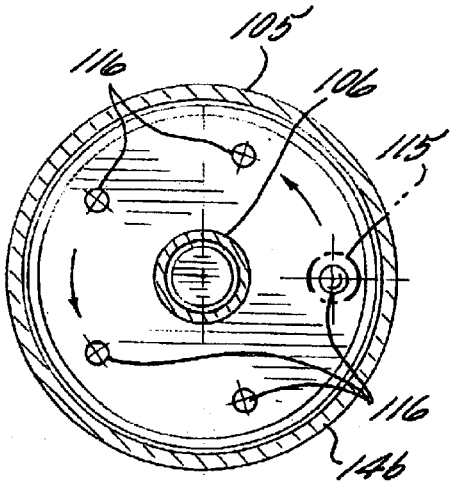
FIGS. 12 and 13 are horizontal sections, taken in the plane of line 12—12 and 13—13 in FIG. 11.
Figure 13:
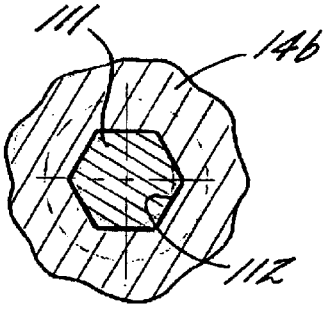

In further carrying out the invention, means are provided for individually adjusting the flow rate of the individual nozzles, notwithstanding their ganged interconnection by common fluid supply lines. To this end, each spray module 10 has an individual flow control knob 105 at its upper end for easy access and use. The flow control knob 105 is rotatably supported on the cartridge body 14 by an axial stem 106 extending in depending relation to the knob 105 and fixed thereto by a screw 108. The stem extends through a central bore in the cartridge body and is retained against axial movement by a small outwardly extending flange 109 at the lowermost end of the stem 106. The stem 106 has a downwardly opening threaded aperture 107 within which a threaded shaft 110 of a downwardly extending plunger stop 111 is engaged (as shown in FIGS. 11 and 13). The plunger stop 111 has a hex-shaped lower head which is axially movable in a complementary-shaped counterbore 112 in the cartridge body 14*b*. For selectively establishing a desired flow rate for the spray module 10, rotation of the control knob 105 will cause axial advancement or retraction of the plunger stop 111, which in turn will set the stroke distance "d" of the valve needle retainer cap 36. As will be understood by one skilled in the art, progressively larger strokes of the valve needle 15 permit progressively greater liquid discharge.

In order to permit easy and precise adjustment in the liquid discharge, the control knob 105 in this case has a downwardly directed spring biased detent 115 in the underside thereof which can be moved between successive circumferentially spaced detent recesses 116 in the upper end of the cartridge body 146. Depending upon the pitch of the threads between the plunger stop shaft 110 and the adjusting knob stem 106 spindle, predetermined flow rate changes can be effected based upon predetermined stepped rotational movement of the knob between successive detent stops as effected by the detent recesses 116. If each detent recess permits rotation of the adjusting knob and hence, axial displacement of the plunger stop 111 a distance corresponding to 5% of the flow rate, movement of adjustment through four detents, for example, will change the flow rate by 20%. It will be appreciated by one skilled in the art that by reason of such control knob 105, which is easily accessible to a user, the flow rates of the individual spray modules 10 in a ganged array may be precisely set for the desired spray application. It can be seen, therefore, that adjustment of the flow rate may be easily effected and controlled by counting the tactile detent clicking as an incident to control knob rotation. Alternatively, appropriate adjustment markings can be provided on the module.

From the foregoing, it can be seen that the spray module of the present invention is adapted for easy connection to fluid supply lines, with the spray gun cartridge being removable for repair and/or replacement. The spray modules also are adapted for each connection in side-by-side ganged or manifold arrays, for connection to common fluid supplies. Yet, even with the spray modules gang mounted, the individual spray cartridges are removable and replaceable and the flow rate of individual nozzles can be selectively adjusted and controlled. Moreover, the spray modules have a relatively simple construction which lends themselves to economical manufacture and reliable operation.

What is claimed is:

1. A liquid spray module comprising:

a spray gun cartridge including an elongated cartridge body with a central liquid passage, a spray nozzle at a discharge end of said cartridge body having a liquid discharge orifice in communication with said cartridge body liquid passage, a valve needle mounted for reciprocating movement within said cartridge body for controlling liquid passage through said discharge orifice, said cartridge body having a cylinder air passage into which pressurized air may be directed for reciprocating said valve needle between on and off positions, said cartridge body having an atomizing air passage into which pressurized air may be directed for assisting in atomization of liquid to be discharged from said nozzle, a manifold body having an elongated bore extending therethrough into which said spray gun cartridge is removably mounted, and said manifold body having a liquid inlet passage and at least one pressurized air inlet passage on a common side thereof for connection with fluid supply lines for permitting communication of liquid to said spray gun cartridge liquid passage and pressurized air to said cylinder air and atomizing air passages when said spray gun cartridge is mounted in said manifold body bore, and said spray gun cartridge being removable from said manifold body without disconnection of said fluid supply lines from said manifold body.

2. The liquid spray module of claim 1 in which said spray gun cartridge is supported within said manifold body bore with the spray nozzle extending outwardly of one end of said manifold body and an upstream end of said cartridge extending outwardly of an opposite end of said manifold body.

3. The liquid spay module of claim 2 in which said spray nozzle includes a selectively removable air cap, and said module is mountable in said manifold body bore with said air cap disposed below the manifold body for removal and replacement from the nozzle without removal of said cartridge from said manifold body.

4. The liquid spray module of claim 1 in which said manifold body is a generally rectangular shaped block with said bore extending through top and bottom ends thereof, and said liquid and air inlet passages extend through a side of said manifold body into communication with said bore.

5. The liquid spay module of claim 3 in which said manifold body bore extends through top and bottom ends of said manifold body, said liquid and air inlet passages communicating with said bore through a side of said manifold body, and said manifold body has a liquid outlet passage and at least one pressurize air outlet passage communicating with said bore through a side of said manifold body opposite the side in which said inlet passages are formed.

6. The liquid spray module of claim 5 in which said spray gun cartridge and manifold body define respective circumferential passages between said liquid inlet and outlet passages and between said air inlet and outlet passages.

7. The liquid spray module of claim 5 including a removable adaptor plate mounted on a side of said manifold body for closing off said manifold body outlet passages.

8. The liquid spray module of claim 7 including an adaptor plate removably mounted on a side of said manifold body having liquid and air passages communicating with said liquid and air inlet passages in said manifold body, respectively, and liquid air supply lines connected to said adaptor plate in communication with said adaptor plate liquid, cylinder air, and atomizing and air passages, respectively.

9. The liquid spray module of claim 1 in which said manifold body is formed with two pressurized air inlet passages, said air inlet passages including a cylinder air inlet passage connectable to a cylinder air supply line and communicating with said cartridge cylinder air passage and an atomizing air inlet passage connectable to an atomizing air supply line and communicating with said cartridge atomizing air passage when said cartridge is mounted in said manifold body.

10. The liquid spray module of claim 9 including a plurality of annular sealing members interposed between an outer perimeter of said cartridge and said manifold body bore for sealing said liquid, air atomizing and cylinder air passages from each other.

11. The liquid spray module of claim 1 in which said cartridge body and manifold bore are inwardly tapered in a downstream direction.

12. The liquid spray module of claim 11 in which said nozzle body bore defines a plurality of tiers that are progressively smaller in diameter in a downstream direction, and including at least one annular sealing member between the manifold body bore and cartridge at each tier when said cartridge is mounted in said bore.

13. The liquid spray module of claim 12 in which said tiers each are generally cylindrical in shape.

14. The liquid spray module of claim 1 in which said valve needle is connected to a piston mounted for reciprocating movement under the control of pressurized air in said cylinder air passage between a valve closing position and a valve opening position, and a valve stop for limiting the stroke of movement of said valve piston upon movement to said valve opening position, and a liquid control member rotatably mounted on an upper end of said cartridge body, and said valve piston stop being adjustably positionable for selectively altering the stroke of piston movement in response to rotation of said control member.

15. The liquid spray module of claim 14 including a detent between said rotatable control member and said cartridge body for locating said control member at predetermined rotative positions.

16. The liquid spray module of claim 13 in which said detent includes a spring biased detent member mounted in one of said control member and cartridge body and a plurality of circumferentially spaced detent recesses formed in the other of said control member and cartridge body for receiving the detent member at selective rotative positions of said control member.

17. A liquid spraying system comprising a plurality of liquid spray modules, said modules each including a spray gun cartridge and a manifold body, said spray gun cartridges each including a cartridge body with a liquid passage into which pressurized liquid may be directed and an air passage into which pressurized air may be directed, a spray nozzle at a discharge end of said cartridge body having a liquid discharge orifice in communication with said cartridge body liquid passageway, and said manifold body of each module having an elongated bore extending therethrough into which a respective spray gun cartridge is removably mounted, said manifold body of each module having a liquid inlet passage communicating with the liquid passage of a spray gun cartridge mounted in said manifold body bore and a pressurized air inlet passage communicating with the air passage of a spray gun cartridge mounted in said manifold body bore, said manifold body of each module having a liquid outlet passage and a pressurized air outlet passage formed therein, respectively, communicating with the liquid and air passages of a spray gun cartridge mounted in said manifold body, said manifold bodies of a plurality of said modules being connected in a side-by-side array with respective liquid and air inlet and outlet passages of adjacent modules connected in fluid communication with each other, and each spray gun cartridge being removable from the respective manifold body in which it is mounted without disconnection of said manifold bodies from each other or removal of the manifold body from said array.

18. The liquid spraying system of claim 17 including respective fluid supply lines connected to the inlet passages of the manifold body of the fist module in the array and respective fluid discharge lines connected to the manifold body outlet passages of the last module of the array.

19. The spraying system of claim 18 in which said pipes are fixed between adjacent manifolds with ends of the pipes positioned in manifold body inlet and outlet passages.

20. The spraying system of claim 17 in which individual pipes interconnect the manifold body liquid and air inlet passages with respective liquid and air outlet passages of an adjacent module.

21. The spraying system of claim 20 in which said manifold bodies of the first and last modules of the array have annular seals about said manifold body inlet and outlet passages, said annular seals being exposed on a respective side of the manifold body, and a removable adaptor plate mounted on each side of the manifold body for retaining said annular seals.

22. The spraying system of claim 20 in which the manifold bodies of the module intermediate modules at opposite ends of said array each have annular seals about said manifold body inlet and outlet passages for sealing contact with a respective pipe positioned in the passage, and said annular seals each being located in recessed relation to a respective side of the manifold body of the intermediate module.

23. The liquid spraying system of claim 17 in which said liquid and air inlet passages of each manifold body are on a common side of the manifold body and said liquid and air discharge passages of each manifold body are on a common side of said manifold body opposite of said inlet passages.

24. The liquid spraying system of claim 23 in which said manifold body inlet passages communicate with the bore of the manifold body in perpendicular relation to the axis of the bore.

25. The liquid spraying system of claim 23 in which said inlet and outlet passages of each module body are in lines parallel to the axis of the manifold body bore.

26. The liquid spraying system of claim 17 in which each cartridge has a valve needle mounted for reciprocating movement within said cartridge body for controlling liquid passage through said discharge orifice, and said air passage in each cartridge body is a cylinder air passage into which pressurized air communicated from said manifold body air inlet passage is effective for reciprocating said valve needle between on and off positions.

27. The liquid spraying system of claim 26 in which each said cartridge body has an atomizing air passage into which pressurized air may be communicated for assisting in atomization of liquid to be discharged from said nozzle, each said manifold body being formed with two pressurized air inlet passages, said air inlet passages including a cylinder air inlet passage connectable to a cylinder air supply line and communicating with a cartridge cylinder air passage and an atomizing air inlet passage connectable to an atomizing air supply line and communicating with said cartridge atomizing air passage of a cartridge mounted in said manifold body.

28. The liquid spraying system of claim 26 in which the valve needle of each cartridge is connected to a piston mounted for reciprocating movement under the control of pressurized air in said cylinder air passage between a valve closing position and a valve opening position, a valve stop for limiting the stroke of movement of said valve piston upon movement to said valve opening position, a liquid control member rotatably mounted on an upper end of said cartridge body, and said valve piston stop being adjustably positionable for selectively altering the stroke of piston movement in response to rotation of said control member.

29. The liquid spraying system of claim 17 in which the air passage in each cartridge body is an atomizing air passage into which pressurized air communicated from said manifold body air inlet passage is effective for assisting in atomization of liquid to be discharged from said nozzle.

30. The liquid spraying system of claim 17 in which each said spray gun cartridge is supported within the respective manifold body bore with the spray nozzle extending outwardly of one end of said manifold body and an upstream end of said cartridge extending outwardly of an opposite end of said manifold body.

31. The liquid spraying system of claim 17 in which each said manifold body is a generally rectangular shaped block with the bore therein extending through top and bottom ends thereof and the liquid and air inlet passages therein extending through a side of said manifold body into communication with said bore.

32. The liquid spraying system of claim 17 in which each said spray gun cartridge and respective manifold body define respective circumferential passages between said liquid inlet and outlet passages and between said air inlet and outlet passages.

33. The liquid spraying system of claim 17 in which each said nozzle body bore is defined by a plurality of tiers that are progressively smaller in diameter in a downstream direction, and including at least one annular sealing member at each tier between the manifold body bore and cartridge mounted therein at each tier.

* * * * *